US007380289B2

(12) United States Patent
Kordecki, Jr. et al.

(10) Patent No.: US 7,380,289 B2
(45) Date of Patent: Jun. 3, 2008

(54) MITT FOR THUMB, INDEX FINGER, AND MIDDLE FINGER

(76) Inventors: Stanley E Kordecki, Jr., 5654 Kiwanis Place NE., St. Petersburg, FL (US) 33703; Stanley E Kordecki, III, 5654 Kiwanis Place NE., St. Petersburg, FL (US) 33703

( * ) Notice: Subject to any disclaimer, the term of this patent is extended or adjusted under 35 U.S.C. 154(b) by 0 days.

(21) Appl. No.: 11/419,553

(22) Filed: May 22, 2006

(65) Prior Publication Data

US 2006/0277657 A1 Dec. 14, 2006

Related U.S. Application Data

(60) Provisional application No. 60/594,989, filed on May 25, 2005.

(51) Int. Cl.
*A41D 19/00* (2006.01)

(52) U.S. Cl. ..... 2/163; 2/161.6; 2/169

(58) Field of Classification Search ..... 2/16, 2/20, 21, 163, 161.6
See application file for complete search history.

(56) References Cited

U.S. PATENT DOCUMENTS 2,751,592 A * 6/1956 Longstreth et al. ..... 2/21
4,573,220 A * 3/1986 Baker ..... 2/161.1
D389,608 S * 1/1998 Kraatz ..... D29/123
5,966,741 A * 10/1999 Klecina ..... 2/169
6,687,911 B2 * 2/2004 Fitz ..... 2/21
6,868,999 B1 * 3/2005 Gochanour ..... 225/90
7,051,378 B1 * 5/2006 Mire ..... 2/161.7
D524,489 S * 7/2006 Scott ..... D29/113

* cited by examiner

*Primary Examiner*—Katherine Moran
*Assistant Examiner*—Sally Colson Cline
(74) *Attorney, Agent, or Firm*—Ronald E. Smith; Smith & Hopen, P.A.

(57) ABSTRACT

A pair of gloves for keeping fingers clean during the eating of juicy foods includes a left-hand glove having a first pocket for receiving a left thumb, a second pocket for receiving a left index finger, and a third pocket for receiving a left middle finger and a right-hand glove having a first pocket for receiving a right thumb, a second pocket for receiving a right index finger, and a third pocket for receiving a right middle finger. The ring and little fingers of a user's hands are not protected and are held in spaced apart relation to the food during consumption. The gloves are made from whole gloves formed of a thin vinyl by cutting off the pockets for receiving the ring and little fingers of each hand.

4 Claims, 3 Drawing Sheets

MITT FOR THUMB, INDEX FINGER, AND MIDDLE FINGER

CROSS REFERENCE TO RELATED APPLICATIONS

This application claims priority to currently pending U.S. Provisional Patent Application 60/594,989, entitled, Mitt for Thumb, Index Finger and Middle Finger", filed May 25, 2005 by the same inventors.

BACKGROUND OF THE INVENTION

1. Field of the Invention

This invention relates, generally, to gloves or mittens. More particularly, it relates to a structure that covers the thumb and two opposable fingers to keep them clean during meals that include edible items of the type that are smothered in juice, grease, and the like, and that are intended to be eaten without utensils.

2. Description of the Prior Art

Conventional gloves provide individual pockets for all five digits of a hand—the thumb and four fingers. Conventional mittens provide only two pockets—one for the thumb and a large one for all four fingers.

Neither a conventional glove nor a conventional mitten has utility in connection with the eating of so-called finger-foods (foods eaten while being held in the hand) that include high levels of juices or other viscuous substances.

Ribs and chicken wings are two such products—they are typically eaten without utensils. The diner must hold onto the wing, rib, or the like with the bare hand. The user's fingers and thumbs therefore become heavily coated with juices.

Cleaning the juices from the fingers and thumbs is problematic—conventional cloth or paper dry napkins are often inadequate. Pre-wetted napkins perform better.

Typically, a person who has eaten juicy finger foods is required to excuse themselves from the table and scrub their hands in a sink.

The problem with napkins, whether dry or wet, is that they must be initially held when the fingers are covered with juices. Accordingly, the napkin is soiled before it can be used. To clean the fingers and thumb of a first hand, the fingers and thumb of a second, grease-covered hand must be used to hold the napkin. Accordingly, the newly cleaned first hand must then grasp the soiled napkin and attempt to clean the digits of the second hand. This process can make the digits of the first hand dirty, requiring the process to be formed again.

The juicy finger-food problem could be imperfectly solved by supplying gloves or mittens to be worn by the diners. However, most people object to eating a meal while wearing conventional gloves or mittens.

The problem is particularly acute in restaurants or at formal catered events. The diners are often wearing clothing that is more expensive than their casual home attire. Moreover, the public nature of such events further increases the concerns of the diners concerning cleanliness. Many well-dressed, well-manicured people attending a public event where food is served might even decline to eat if the only foods served are juicy or greasy or otherwise observed to be messy.

What is needed, then, is an invention that enables people to consume juicy foods such as wings and ribs at formal restaurants and catered events while wearing formal attire and without reliance upon napkins or trips to a washroom.

However, in view of the prior art taken as a whole at the time the present invention was made, it was not obvious to those of ordinary skill in the art how such invention could be provided. It follows that it was not obvious how to provide such invention in a cost-effective way.

SUMMARY OF THE INVENTION

The long-standing but heretofore unfulfilled need for a device that overcomes problems associated with eating juicy foods is now met by a new, useful, and non-obvious invention.

The novel pair of gloves that protects a user's fingers from getting juices on them while holding juicy foods includes a first glove adapted to fit three digits of a left hand and a second glove adapted to fit three digits of a right hand.

The first glove has a first pocket adapted to receive a left-hand thumb, a second pocket adapted to receive a left-hand index finger, and a third pocket adapted to receive a left-hand middle finger.

The second glove has a first pocket adapted to receive a right-hand thumb, a second pocket adapted to receive a right-hand index finger, and a third pocket adapted to receive a right-hand middle finger.

A person wearing the first and second gloves holds a food item at a first end thereof by grasping a first end of the food item with the thumb, index finger, and middle finger of a left hand and holds the food item at a second end thereof by grasping the second end of the food item with the thumb, index finger, and middle finger of a right hand.

The first and second gloves are preferably constructed of a thin, flexible vinyl but other suitable materials are within the scope of this invention.

A novel method of making a pair of gloves that protects the fingers from getting juices on them while holding juicy foods includes the steps of providing a pair of gloves formed of a thin vinyl. The pair of gloves includes a left-hand glove having five pockets and a right-hand glove having five pockets.

In the left-hand glove, a first pocket is adapted to receive a left thumb, a second pocket is adapted to receive a left index finger, a third pocket is adapted to receive a left middle finger, a fourth pocket is adapted to receive a left ring finger, and a fifth pocket is adapted to receive a left little finger;

In the right-hand glove, a first pocket is adapted to receive a right thumb, a second pocket is adapted to receive a right index finger, a third pocket is adapted to receive a right middle finger, a fourth pocket is adapted to receive a right ring finger, and a fifth pocket is adapted to receive a right little finger.

The novel method further includes the steps of providing a cutting instrument capable of cutting thin vinyl, cutting the left-hand glove from a first point to a second point and cutting the right-hand glove from a first point to a second point. Both cuts have an "L" shape.

More particularly, the first point of the left-hand glove is where the pocket adapted to receive the left middle finger meets the pocket adapted to receive the left ring finger. The cut includes a first straight part that extends from said first point toward the wrist-receiving end of the left-hand glove in substantially parallel relation to a longitudinal axis of the left-hand glove. The cut further includes a second straight part normal to the first straight part that extends from the end of the first straight part in an inboard direction to a point on the inboard side of the left-hand glove that is between the thumb-receiving first pocket and the wrist-receiving end of the left-hand glove.

The first point of the right-hand glove is where the pocket adapted to receive the right middle finger meets the pocket adapted to receive the right ring finger. The cut includes a first straight part that extends from said first point toward the wrist-receiving end of the right-hand glove in substantially parallel relation to a longitudinal axis of the right-hand glove. The cut further includes a second straight part normal to the first straight part that extends from the end of the first straight part in an inboard direction to a point on the inboard side of the right-hand glove that is between the thumb-receiving first pocket and the wrist-receiving end of the right-hand glove.

The primary advantage of the invention is that it solves a long-standing problem in the food-services industry.

A more specific advantage is that the invention provides a protection means for the digits used in holding a finger-food.

Another important advantage of the invention is that the novel three-digit gloves can be mass-produced at very low cost and therefore provided free to consumers by restaurants, caterers, or other establishments that serve juicy or otherwise messy foods.

Another advantage is that each novel glove can be made very quickly by cutting conventional disposable vinyl gloves.

Still another advantage is that the cut-off part of the disposable vinyl gloves may be re-cycled so that the material is not wasted.

These and other advantages will become apparent as this disclosure proceeds. The invention includes the features of construction, arrangement of parts, and combination of elements set forth herein, and the scope of the invention is set forth in the claims appended hereto.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE PREFERRED EMBODIMENT

Figure 1:
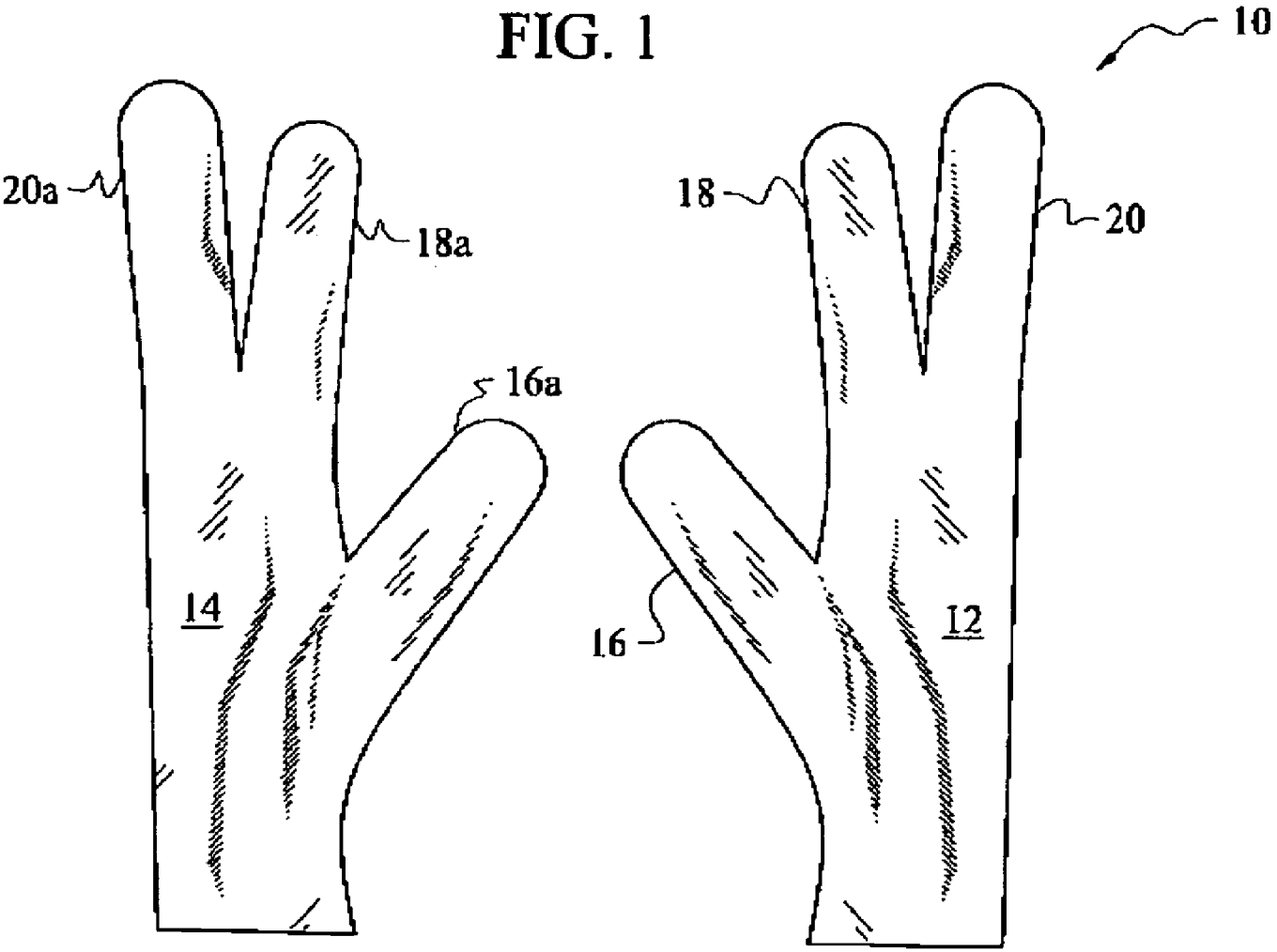
FIG. 1 is a top plan view of a pair of the novel three digit glove.
Figure 2:
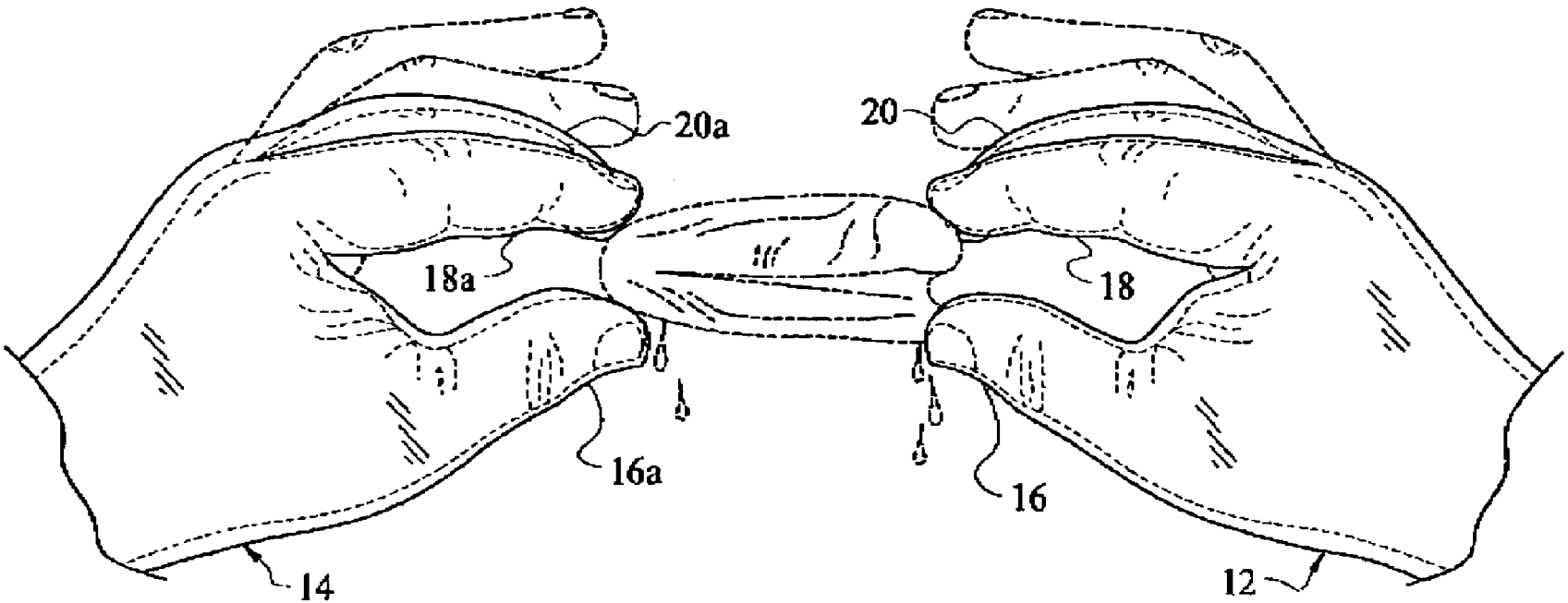
FIG. 2 is a perspective view depicting the novel gloves when in use.

Referring now to FIGS. 1 and 2, it will there be seen that an illustrative embodiment of the invention is denoted as a whole by the reference numeral 10.

The novel pair of gloves 10 includes a right hand glove 12 and a left hand glove 14. Each glove includes a first pocket 16 adapted to receive a thumb, a second pocket 18 adapted to receive an index finger, and a third pocket 20 adapted to receive a middle finger.

The inboard side of each glove is the thumb side thereof and the outboard side of each glove is the little finger side thereof.

Unlike a conventional glove, each glove of the novel pair of gloves includes no pocket adapted to receive a ring finger and no pocket adapted to receive a little finger. As best understood in connection with FIG. 2, the ring fingers and little fingers are held in spaced apart relation to the food during consumption thereof. Such fingers therefore are left unsheathed.

Chicken wings, ribs, and other juicy foods are easily handled by a right thumb, right index finger, and right middle finger working in conjunction with a left thumb, a left index finger, and a left middle finger as is clear from FIG. 2.

Figure 3:
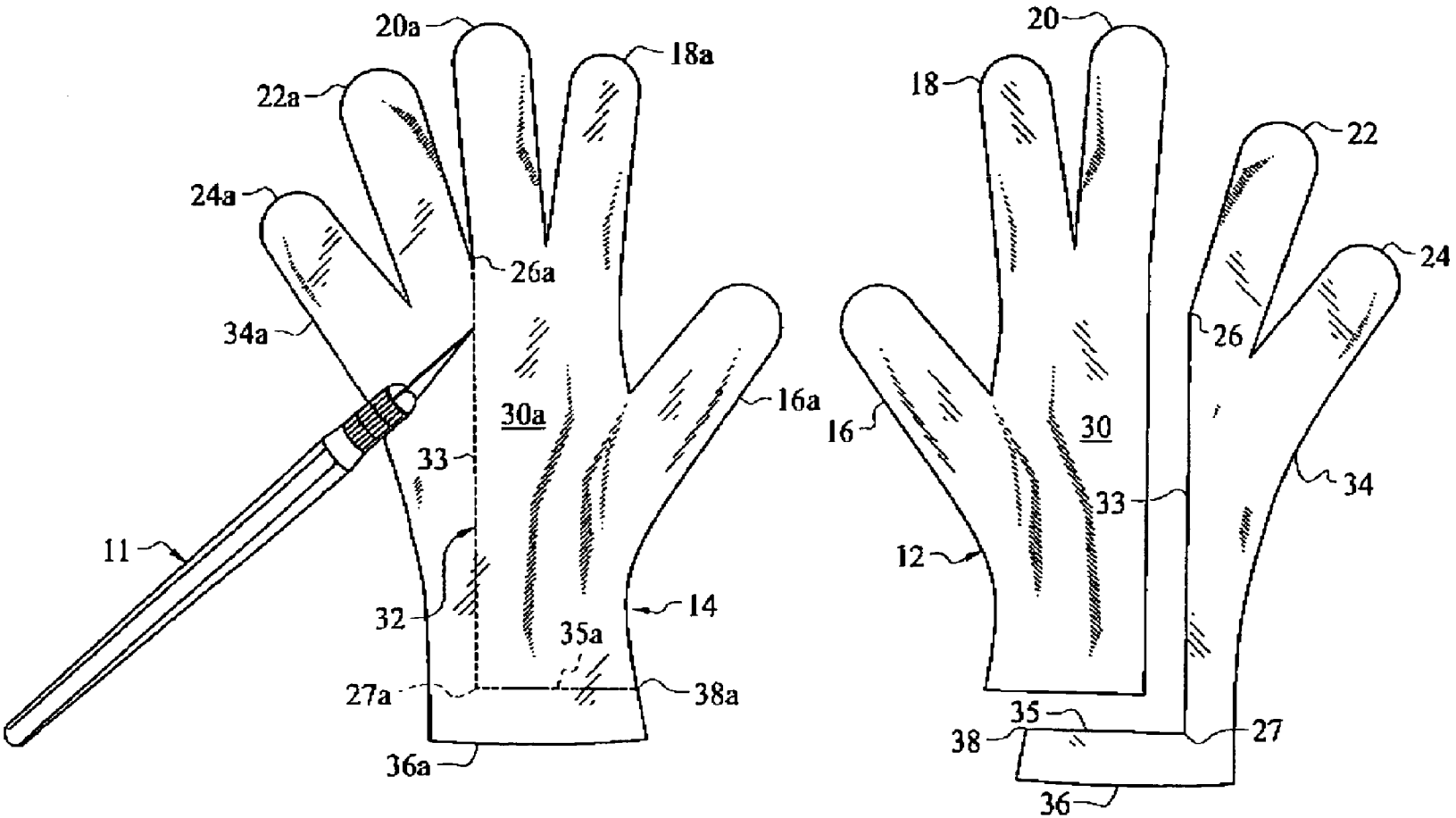
FIG. 3 is a top plan view depicting how a pair of conventional gloves is cut to make the novel gloves.

Novel gloves 10 may be manufactured as drawn or they may be made by cutting a pair of conventional gloves as depicted in FIG. 3. If the method of FIG. 3 is selected, the starting materials are preferably provided in the form of disposable vinyl gloves. A suitable cutting instrument 11 severs sarting material gloves 30. 30*a* along "L"-shaped cutting line 32 having a longitudial part 33 and a transverse part 35. Parts 34 34*a* that are cut off are re-cycled so that more disposable vinyl gloves may be made. The vinyl is thin and flexible.

More particularly, a novel method of making a pair of gloves that protects the fingers from getting juices on them while holding juicy foods, includes the steps of providing a pair of gloves formed of a thin vinyl.

The pair of gloves includes a left-hand glove 14 having five pockets. A first pocket 16*a* of said five pockets is adapted to receive a left thumb, a second pocket 18*a* of said five pockets is adapted to receive a left index finger, a third pocket 20*a* of said five pockets is adapted to receive a left middle finger, a fourth pocket 22*a* of said five pockets is adapted to receive a left ring finger, and a fifth pocket 24*a* of said five pockets is adapted to receive a left little finger.

The pair of gloves also includes a right-hand glove 12 having five pockets. A first pocket 16 of said five pockets is adapted to receive a right thumb, a second pocket 18 of said five pockets is adapted to receive a right index finger, a third pocket 20 of said five pockets is adapted to receive a right middle finger, a fourth pocket 22 of said five pockets is adapted to receive a right ring finger, and a fifth pocket 24 of said five pockets is adapted to receive a right little finger.

The method further includes the steps of providing a cutting instrument 11 capable of cutting thin vinyl and cutting left-hand glove 14 from a first point to a second point. As best understood in connection with FIG. 3, the first point 26*a* is where pocket 20*a*, adapted to receive a left middle finger, meets pocket 22*a* adapted to receive a left ring finger. Cut 32 includes a first straight part 33*a* that extends from said first point 26*a* toward the wrist-receiving end 36*a* of left-hand glove 14 in substantially parallel relation to a longitudinal axis of the left-hand glove, said first straight part ending at second point 27*a*. The cut further includes a second straight part 35*a* normal to the first straight part 33*a* that extends from second point 27*a* of the first straight part 33*a* in an inboard direction to an inboard point 38*a* on the inboard side of the left-hand glove 14 that is between the thumb-receiving first pocket 16*a* and the wrist-receiving end 36*a* of the left-hand glove.

Right-hand glove 12 is similary cut from a first point 26 to a second point 27. First point 26 is where pocket 20 adapted to receive the right middle finger meets pocket 22 adapted to receive the right ring finger. The cut includes a-first straight part 33 that extends from said first point 26 toward the wrist-receiving end 36 of die right glove 12 in substantially parallel relation to a longitudinal axis of the right-hand glove. The cut further includes a second straight part 35 normal to first straight part 33 that extends from the end of the first straight part in an inboard direction to a point 38 on the inboard side of the right-hand glove that is between the thumb-receiving first pocket 16 and wrist-receiving end 36 of the right-hand glove.

Although the primary utility of the novel gloves is at restaurants or catered events, the novel gloves may also be used at home or at other informal meals such as picnics. Thus it is understood that the utility is not limited to formal or relatively formal meals.

Restaurants that serve chicken wings, ribs, or other juicy foods, may supply the novel gloves with a meal, there being one pair of gloves at each plate setting.

Take-out restaurants could also supply the novel gloves as needed. Thus, a take-out order for chicken wings sufficient to serve six (6) people would include six (6) pair of the novel gloves, at no charge to the consumer. A take-out order for ribs sufficient to serve four (4) people would include four (4) pair of gloves, and so on.

The invention provides a simple yet effective solution to a problem associated with finger-foods. It is easy to use and economical to manufacture. It is made from low cost, readily available materials. Its method of use is self-explanatory and it may be disposed of after use.

It will thus be seen that the objects set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A method of making a pair of gloves that protects the fingers from getting juices on them while holding juicy foods, comprising the steps of:

providing a pair of gloves formed of a thin vinyl;

said pair of gloves including a left-hand glove having five pockets and a wrist-receiving end;

a first pocket of said five pockets adapted to receive a left thumb;

a second pocket of said five pockets adapted to receive a left index finger, a third pocket of said five pockets adapted to receive a left middle finger;

a fourth pocket of said five pockets adapted to receive a left ring finger, a fifth pocket of said five pockets adapted to receive a left little finger;

said pair of gloves including a right-hand glove having five pockets and a wrist-receiving end;

a first pocket of said five pockets adapted to receive a right thumb;

a second pocket of said five pockets adapted to receive a right index finger, a third pocket of said five pockets adapted to receive a right middle finger;

a fourth pocket of said five pockets adapted to receive a right ring finger, and a fifth pocket of said five pockets adapted to receive a right little finger;

providing a cutting instrument capable of cutting thin vinyl;

forming a cut in said left-hand glove from a first point to a second point;

said first point being where said pocket adapted to receive said left middle finger meets said pocket adapted to receive said left ring finger;

said cut in said left-hand glove including a first straight part that extends from said first point to a second point near the wrist-receiving end of the left glove in substantially parallel relation to a longitudinal axis of the left-hand glove;

said cut in said left-hand glove further including a second straight part normal to the first straight part that extends from the second point in an inboard direction to an inboard point on the inboard side of the left glove that is between the thumb-receiving first pocket and the wrist-receiving end of the left glove;

forming a cut in said right-hand glove from a first point to a second point;

said first point being where said pocket adapted to receive said right middle finger meets said pocket adapted to receive said right ring finger; and said cut in said right-hand glove including a first straight part that extends from said first point to a second point near the wrist-receiving end of the right-hand glove in substantially parallel relation to a longitudinal axis of the right-hand glove;

said cut in right-hand glove further including a second straight part normal to the first straight part that extends from the second point in an inboard direction to an inboard point on the inboard side of the right-hand glove that is between the thumb-receiving first pocket and the wrist-receiving end of the right-hand glove.

2. A pair of gloves made by the method of claim 1.

3. A left hand glove made by the method of claim 1.

4. A right hand glove made by the method of claim 1.

* * * * *